United States Patent [19]

Koppelmans

[11] Patent Number: 4,474,294

[45] Date of Patent: Oct. 2, 1984

[54] SYSTEM FOR DISTRIBUTING AND MAKING AVAILABLE TO THE USER ARTICLES OF FOOD, PARTICULARLY SWEETS

[76] Inventor: Henricus F. Koppelmans, 113 Barbaralaan, 4834 SJ Breda, Netherlands

[21] Appl. No.: 484,285

[22] Filed: Apr. 12, 1983

[30] Foreign Application Priority Data

Apr. 16, 1982 [NL] Netherlands ..... 8201605

[51] Int. Cl.[3] ..... B65D 85/62; B65D 85/60; B65D 83/04

[52] U.S. Cl. ..... 206/526; 206/535; 206/44.12; 312/42; 312/45; 312/61

[58] Field of Search ..... 206/535, 526, 44.12; 312/45, 42, 61

[56] References Cited

U.S. PATENT DOCUMENTS

| | | | |
|---|---|---|---|
| 1,627,870 | 5/1927 | Seidemann | 312/45 |
| 1,712,080 | 5/1929 | Kelly | 312/42 |
| 1,930,321 | 10/1933 | Ogden | 312/42 |
| 2,545,042 | 3/1951 | Negus, Jr. | 312/61 |

*Primary Examiner*—William T. Dixson, Jr.
*Attorney, Agent, or Firm*—Edmund M. Jaskiewicz

[57] ABSTRACT

A system for making sweets and similar articles of food available to the user. The system comprises a holder adapted to be affixed to e.g. an automobile dashboard, and a package, preferably a blister pack, containing the sweets, and adapted to be slid into the holder so as to rest upon a support. The package can be opened so that the sweets, lying on the support, can be taken out individually.

Preferably several unit packs are interconnected and can be separated by perforations or other tearing lines.

9 Claims, 9 Drawing Figures

SYSTEM FOR DISTRIBUTING AND MAKING AVAILABLE TO THE USER ARTICLES OF FOOD, PARTICULARLY SWEETS

BACKGROUND OF THE INVENTION

The present invention relates to a system for distributing articles and making them available to the user. More particularly the invention relates to such a system for distributing articles of food, still more particularly so-called sweets.

U.S. Pat. No. 2,545,042, to A. I. Negus, Jr., discloses a system for dispensing special filter or sediment disks, as used in the diary industry. This prior art system comprises a holder and at least one casing for taking up a pile of the articles, said casing having a substantially flat rectangular carrier constituting flanges projecting with respect to the casing proper and having two straight edges parallel to the lengthwise direction of the carrier, the holder being substantially flat, having fixation means for the holder and being provided at two parallel sides with edges formed into U-shape at a mutual distance which is adapted to the straight edges of the casing, such that this casing, vertically in the position of use, can be telescoped into the holder until it reaches a stop means, the user being able to take the articles out through an opening near the bottom end of the casing, starting with the lowermost one in the pile.

This prior system is essentially a 4-part system. The disks to be distributed are commerciallized in a carton or package. The dispensing system also comprises a loading element or cartridge, which is inserted in every new carton of disks to take them over. Thereupon the cartridge is inserted in the casing, whereby a cover constituting part of the cartridge, will close the casing. Thereupon the casing is inserted into the mounting plate.

This prior art system is quite complicated to handle, and a further simplification in this respect would be highly desirable, both in terms of cheap production and in terms of what the consumer has to do.

OBJECTS OF THE INVENTION

The primary object of the present invention is to provide a considerable simplification in the system, more particularly to reduce it to a 2-part system instead of a 4-part system.

A further object of the invention is to adapt such simplified system to its use for distributing articles of food, particularly so-called sweets.

Another object is to realize the holder such that a unit pack can be slid into it very simply.

Still another object is to provide a package from which the sweets can be taken out very easily.

SUMMARY OF THE INVENTION

Basically, in the system according to the invention, the casing is realized as a package in which articles of food, particularly sweets, are commercialized, the holder being provided with a support element which constitutes said stop means, projecting from the substantially flat holder portion such that it is able to support, in the position of use, the casing containing the articles, the casing being substantially closed at all sides, except for an opening or a place which can easily be opened, near the bottom end of the casing which, in the position of use, rests upon the support element.

A most interesting application of the system is in automobiles, where the holder can be affixed against the dashboard. Automobile drivers often feel the need for small articles of food, such as peppermint and other so-called sweets. The system, in which a holder containing a supply of such articles, can be affixed to the dashboard, eliminates, as will be clear, the necessity to have these articles in the pocket, or in the coaming or in some other place. With other known packages of these articles, generally rolls, it is not possible, or only with quite an amount of trouble, to take one article out of the roll during driving, when in fact one has no more than one hand available to do so.

With the system of the type to which the invention relates a filled unit package can be slid into the holder, using two hands, at a moment when one has the opportunity for it, particularly at home or during a stop. From that moment on, the articles are permanently available at a desired location, the first article lying upon the support element at the location of the opening, so that it can be taken out through this opening. This can then be done by one hand, as it was meant to be. After removing the first article, the next one in the unit package comes down until it rests upon the support behind the opening provided, so that it can be taken out in its turn. Particularly, displacement of the articles inside the package is envisaged under the influence of gravity, by vertical arrangement of the holder when affixing it.

Further measures to be applied with advantage are defined in the subclaims.

The features of the present invention which are believed to be novel are set forth with particularity in the appended claims.

Other claims and many of the attendant advantages will be more readily appreciated as the same becomes better understood by reference to the following detailed description and considered in connention with the accompanying drawings in which like reference symbols designate like parts throughout the figures.

DESCRIPTION OF THE DRAWINGS

FIG. 3 shows the same holder at a moment while the unit package is being telescoped into the holder.

FIGS. 7, 8 and 9 show a holder in another embodiment, in an empty condition from the front, in filled condition from the front and in filled condition from the rear, respectively.

DESCRIPTION OF THE PREFERRED EMBODIMENTS

Figure 4:
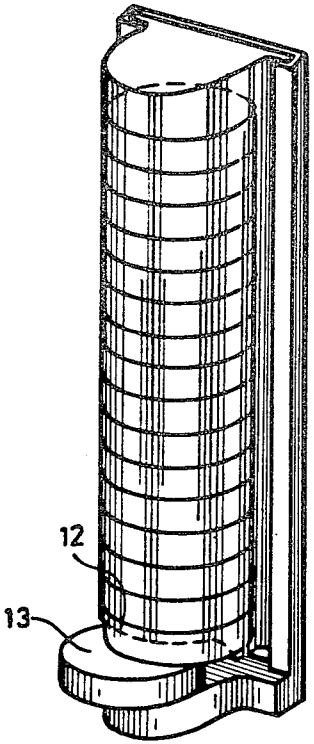
FIG. 4 shows the next phase in which the unit package is in the holder in the position of use, for illustration the lowermost article having been taken out already over a certain distance.

Referring to FIGS. 1–4, the holder, indicated as a whole by 1, comprises a flat, rectangular main part 2. The longer sides thereof are realized as sections, 3, 3' bent over in the same sense into U-shape, extending substantially over the entire length of part. 2. In this way, two guide profiles are performed.

At the bottom an abutment element or support element 4 is provided. The embodiment in the drawing is envisaged to be a mass article in plastic material. The support element 4 can be pivotable with respect to portion 2 by making the material at the transition 5 so thin that it becomes flexible. If desired, when applying plastic material which is more rigid in itself, plasticizers may be applied in known manner. (Alternatively, for the purpose aimed at, it is possible to apply a hinge connection consisting of ears formed on the two parts, cooperating with a hinge pin.)

The support element 4 along the side is provided with a lip 6 having a thicker edge 7. The thicker edge is adapted, when swinging part 4 over, as indicated by an arrow in FIG. 1, to snappingly engage a slit 8 provided at a corresponding distance from the hinge axis in the flat holder part 2.

It is visible from the drawing that the thickness of the support element 4 has been selected slightly exceeding the thickness of the material of the remaining holder part 2. The purpose of this is to keep the element 4 substantially flat, in any case when it is being charged by a filled unit package, and also to take up possible forces arising when taking the articles out, as will be further described.

Figure 1:
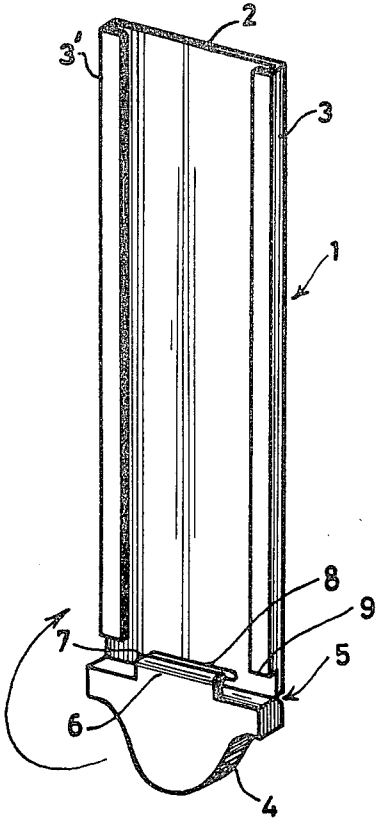
FIG. 1 shows a holder in a first embodiment, in the substantially flat condition in which it is made available.
Figure 5:
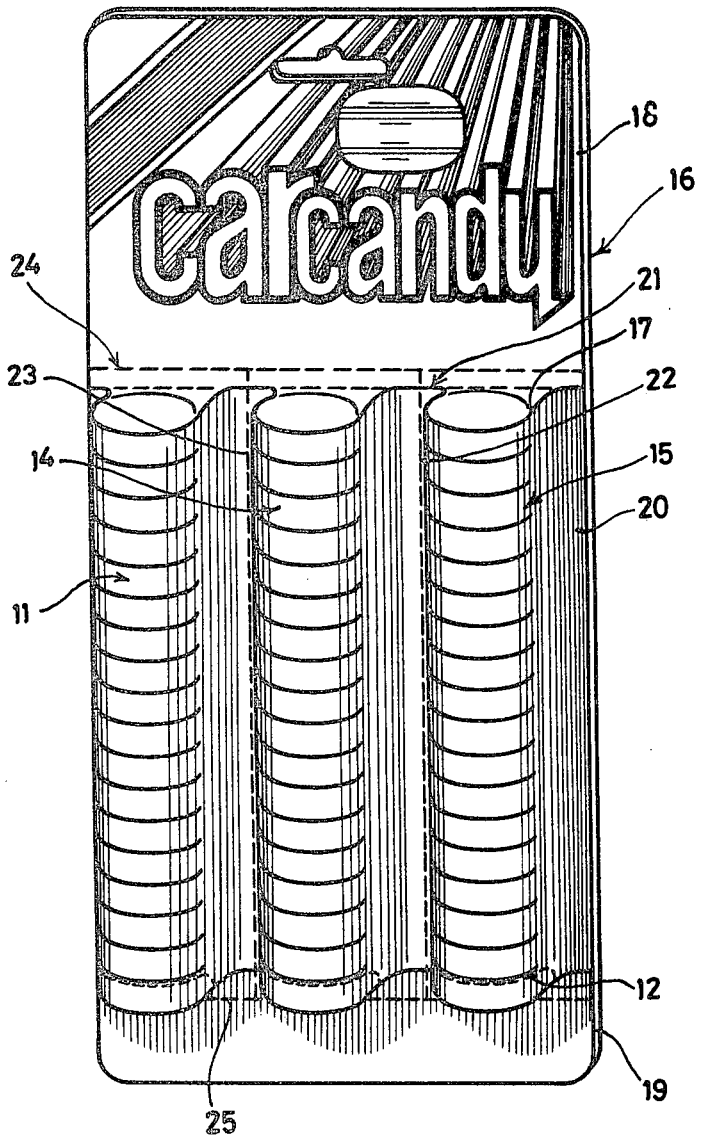
Figure 5:
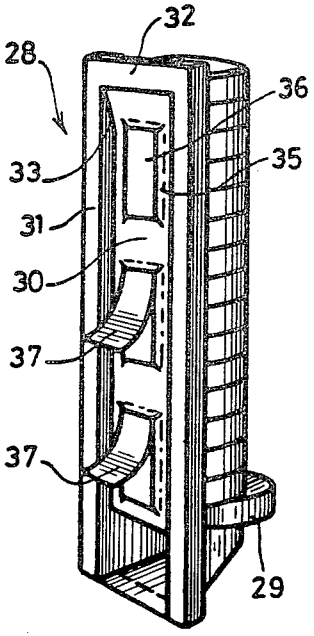
Figure 8:
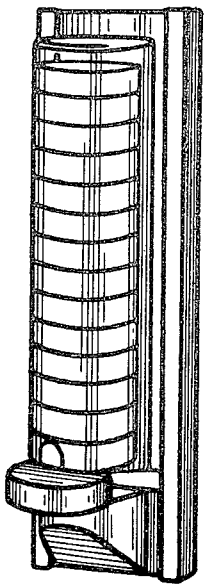

It is visible from FIG. 1 that the guide profiles 3, 3' are provided with recesses 9 to allow for pivoting of the support element 4. The pivoted position, being the position of use, has been represented in FIG. 2.

FIG. 3 shows how a unit package is slid into the holder. Further particulars of the package will be explained below. For a proper understanding at this moment, it need only be pointed out that the unit package is flat at the rear (as viewed in the drawing) and that it has straight edges on either side, such as edge 10, the mutual distance of these parallel longer sides being adapted to the internal dimension of the guide profiles 3, 3' at the holder. Of course, the required clearance is introduced in order to allow for an easy sliding in.

The unit package 11 is slid further downward in the direction of arrow P2 until the bottom thereof rests on platform or support 4, i.e. until the situation represented in FIG. 4 has substantially been reached.

The package also, near one of the ends, comprises a perforation or an other tearing line, which can be seen in FIGS. 3 and 4 indicated by 12. The lowermost portion of the package in FIG. 4 has already been removed along this tearing line, so that the lowermost article 13 can be taken out through the opening. The further articles are piled in the package, as represented in the drawing, and this pile will therefore, after removal of the lowermost article 13, move downward of itself, whereby the next article comes to rest on the platform 4.

Figure 5:
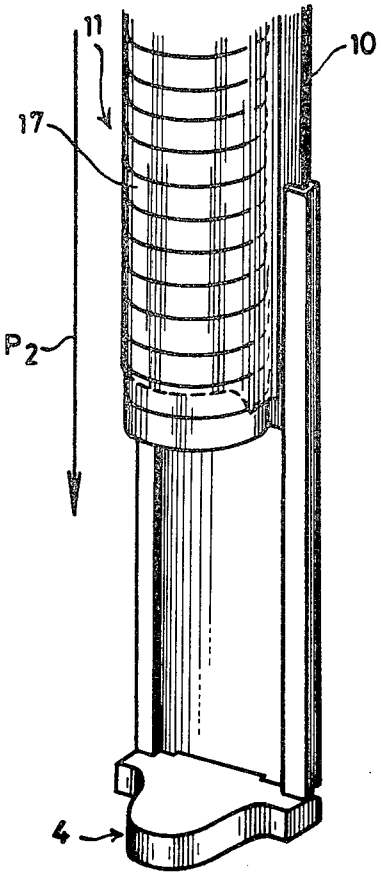
FIG. 5 shows an embodiment of a threefold package.
Figure 2:
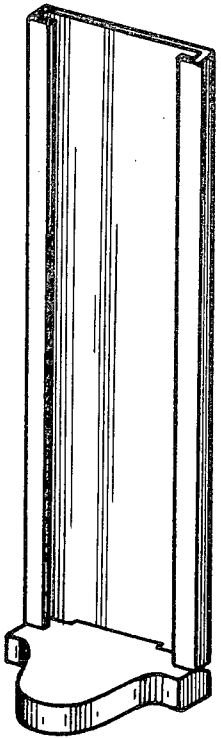
FIG. 2 shows the same holder with the pivoted position, or position of use, of the support element for the articles.

In FIG. 5 an embodiment of the package has been represented, having three unit packages indicated by 11, 14 and 15 respectively. An art of packing which is known in itself has been applied, is known as blister packing. A carrier 16, for example in cardboard, can be provided with a top sheet 17 of plastic foil, preferably transparent. The foil 17 is, as is apparent from FIG. 4, provided with three cavities, each adapted to hold a pile of round, disk-shaped sweets. A face 18 at the top of the cardboard and a face 19 at the bottom are adapted to carry a printed text. At that location, the foil is lying flatly on the cardboard. Along the outer edges, such as 20, and also in strip-shaped areas such as 21 between the neighbouring units such as 14 and 15, the foil is also attached to the carrier cardboard. At the location of these strips such as 21, between the units, tearing lines 22 have been arranged, for example in form of perforations. Such perforations 22 and 23, at a certain height above the unit packages 11, 14, 15 reach a perforation 24 extending transversely across the top face 18, and similarly at the bottom reach a transverse perforation 25. In this way the three unit packages 11, 14, 15 can simply be taken apart by the user.

The attachment of the plastic foil at the location of the strips such as 21, should be so wide that, also after tearing the perforation lines, the connection between foil and cardboard carrier 16 remains intact. Thus, the managable units as presented in FIGS. 3 and 4 are created, which are fit to be slid into the holder 1.

In this embodiment there is furthermore provided an appropriate perforation 26 in the plastic foil, near the bottom. Thereby, just before a unit such as 11 comes to rest with its bottom upon the platform 4, or afterwards the plastic foil below the perforation line 26 can be removed to create an opening in the foil, through which the lowermost article 13 can be taken out. It will now also be clear that the shape and dimensions respectively, of platform 4 have been selected such that, from the front where the user can take the lowermost article by two fingers, such article is bigger than the platform. After taking away the lowermost article, the pile of articles will gradually move downward inside the package. When the whole contents has been used, the empty package can be slid out and a next unit pack can be slid in.

As an easy means of attachment, not only when using it on an automobile dashboard, but also to attach it at other places, the holder 1 may be provided in a manner known per se at the back (not represented) with a self-adhesive strip, which is initially provided with a protecting foil, which can be easily removed.

Figure 6:
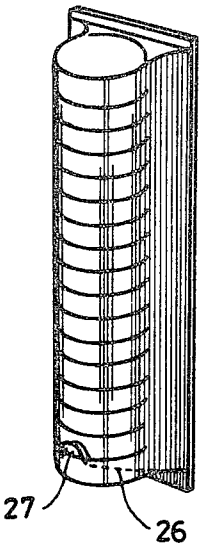
FIG. 6 shows a unit package in another embodiment.

In FIG. 6 another embodiment of the unit package is visible. The difference with the first embodiment is in the fact that in the perforation for making an opening, now indicated by 26, a cut-through lip 27 is included. Particularly because, when bending the plastic material constituting the front of the package, as a consequence of the rigidity of the material, this lip will project slightly forwardly, it serves as an easy means to be able to grip the lowermost part of the packing material and to tear it off along the perforation line 26. In the alternative a tearing lip may comprise a small separate strip of material which is adhered to the lowermost part of the blister material below the perforation line 26.

Figure 7:
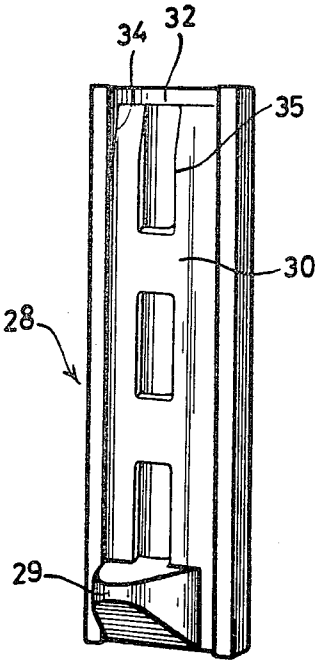

FIG. 7 shows another embodiment of a holder, indicated as a whole here by 28. The manner in which, by U-shaped edges over the entire length, a unit packge can be slid into this holder, is entirely similar to the first embodiment. A first point of difference now, however, is the presence of a fixed platform 29. So the complete holder is a plastic injection moulded product which can be used right away.

Furthermore, the center 30 of the holder main part has been put forward with respect to the frame 31 containing the slide profiles, and which, with cross connections 32, define the plane of contact of the holder against the rear of the package. This construction is best visible from the rear, in FIG. 9, particularly by the presence of the oblique transition line 33. Also it will become clear that, the material thickness being sustantially constant, at the front (FIG. 7) there will be a transition 34 from the cross member 32 to the higher part 30. By this transition initially, when sliding the package into the guide profiles, inside the edges 31, somewhat more room is created, whilst nevertheless, when pushing the package further, it will be kept in its holder without play.

In various locations of the holder main plane 30, a plurality of minor parts 35 has been formed, situated to the rear. They serve as support for pieces 36 of an adhesive layer. With this, in a manner known per se, after removing a protective film 37, the holder can be adhered to a base. Such base may be an automobile dashboard, but as a matter of course, also any other object or support surface.

Although the present invention has been shown and described in connection with a preferred embodiment thereof, it will be apparent to those skilled in the art that many variations and modifications may be made without departing from the invention in its broader aspects. It is therefore intended to have the appended claims cover all such variations and modifications as fall within the true spirit and scope of the invention.

What is claimed is:

1. A device for dispensing articles and making them available to a user comprising a holder and at least one casing for containing a stack of the articles, said casing having a substantially flat rectangular carrier having laterally projecting flanges and said flanges having two straight edges parallel to the longitudinal dimension of the carrier, said holder being substantially flat and being provided at two parallel sides with U-shaped edges at a mutual distance corresponding to the straight edges of the casing such that said casing in the position of use is slidable vertically into the holder until reaching a stop means, there being an opening near the bottom end of the casing whereby the lower-most article in the stack can be removed by a user, said casing comprising a package in which articles of food and the like are commercialized, said stop means being on said holder and comprising a support element projecting from the substantially flat holder such that the support element is able to support in the position of use the casing containing the articles, the casing being substantially closed at all sides except for said opening near the bottom end of the casing, said casing in the position of use resting upon the support element.

2. The device as claimed in claim 1, wherein said support element is pivotable with respect to the main plane of the holder, manufactured as a plastic injection moulded product and carrying the guide profiles, by one of a hinge structure between the two parts, or by a place where the material is thin or has been treated with an appropriate plasticizing agent in order to obtain a hinge function.

3. The device as claimed in claim 2 and further comprising a snap-connection to keep the support element in its operative position, the support element having a lip with a thickened edge adapted to cooperate with a slit in the remaining part of the holder to define said snap connection.

4. The device as claimed in claim 1, wherein that portion of the support element remote from the connection with the remaining holder part, both as regards its shape and as regards its dimensions, has been adapted to and is smaller than the article to be made available when this article in the package lies upon the support element.

5. The device as claimed in claim 1 wherein said carrier is a tube-shaped member wherein the substantially tube-shaped member is realized as a package comprising a flat carrier, the articles to be packed being contained in this carrier by an appropriate shaped foil which is provided with an opening or a place which can easily be opened.

6. The device as claimed in claim 5, wherein several unit packs are interconnected so as to constitute a greater unit, having a common surface adapted to carry information, there being creases, perforations or other tearing lines provided to separate the individual units.

7. The device as claimed in claim 1 wherein the support element is integral with the main plane of the holder.

8. The device as claimed in claim 5, wherein the main plane of the holder has been put forward for the greater part with respect to the rear surface of the guide profile, a number of small face portions being situated backward again, as means to carry fixation means preferably pieces of self-adhesive strip, known per se.

9. The device as claimed in claim 5, wherein the package is provided with a perforation and/or cut with a gripping lip to open the package.

* * * * *